United States Patent [19]

Mulawski

[11] Patent Number: 4,580,690

[45] Date of Patent: Apr. 8, 1986

[54] COINLESS PRESSURE RELIEF DEVICE

[75] Inventor: Walter J. Mulawski, Chelmsford, Mass.

[73] Assignee: Sexton Can Company, Inc., Everett, Mass.

[21] Appl. No.: 722,842

[22] Filed: Apr. 11, 1985

[51] Int. Cl.[4] ..... B65D 51/16; B65D 83/14; F16K 17/14

[52] U.S. Cl. ..... 220/89 A; 137/68.1; 222/397

[58] Field of Search ..... 220/89 A, 207, 260, 220/266, 265, 70, 1 BC; 137/68 R; 222/397

[56] References Cited

U.S. PATENT DOCUMENTS

| | | | |
|---|---|---|---|
| 2,384,810 | 9/1945 | Calleson et al. | 220/1 BC |
| 2,795,350 | 6/1957 | Lapin . | |
| 2,951,614 | 9/1960 | Greene . | |
| 3,292,826 | 12/1966 | Abplanalp . | |
| 3,356,257 | 12/1967 | Eimer . | |
| 3,512,685 | 5/1970 | Ewald . | |
| 3,515,308 | 6/1970 | Hayes et al. . | |
| 3,622,051 | 11/1971 | Benson . | |
| 3,667,644 | 6/1982 | Fortmann . | |
| 3,724,727 | 4/1973 | Zundel . | |
| 3,759,414 | 9/1973 | Beard . | |
| 3,786,967 | 1/1974 | Giocomo et al. . | |
| 3,815,534 | 6/1974 | Kneusel . | |
| 3,826,412 | 7/1974 | Kneusel . | |
| 3,831,822 | 8/1974 | Zundel . | |
| 3,979,009 | 9/1976 | Walker | 220/70 X |
| 4,003,505 | 1/1977 | Hardt . | |
| 4,105,133 | 8/1978 | LaBarge et al. | 220/266 |
| 4,147,271 | 4/1979 | Yamasuchi | 220/70 |
| 4,153,874 | 4/1985 | Mulawski . | |
| 4,158,422 | 6/1979 | Witten et al. . | |
| 4,347,942 | 9/1982 | Jernberg et al. . | |
| 4,416,388 | 11/1983 | Mulawski . | |
| 4,433,791 | 2/1984 | Mulawski . | |
| 4,436,218 | 3/1984 | Beese . | |

FOREIGN PATENT DOCUMENTS

| | | | |
|---|---|---|---|
| 2230333 | 6/1972 | Fed. Rep. of Germany . | |
| 904767 | 8/1962 | United Kingdom | 220/265 |
| 1317377 | 4/1971 | United Kingdom . | |
| 1377941 | 6/1972 | United Kingdom . | |
| 1404995 | 11/1972 | United Kingdom . | |
| 1439548 | 6/1974 | United Kingdom . | |

*Primary Examiner*—Allan N. Shoap

*Attorney, Agent, or Firm*—Thompson, Birch, Gauthier & Samuels

[57] ABSTRACT

A pressure relief device for an internally pressurized container. The device is imperforate, forms an integral part of the container surface, and has a concave annular outer area integrally joined to an inwardly protruding circular central area by an annular intermediate area. These areas have different thicknesses resulting exclusively from the device having been drawn from a metal blank. The juncture of the annular outer and intermediate areas forms a first circular line of strain hardened material having a reduced thickness and increased hardness and strength as compared to the material thickness, hardness and strength of the annular outer area. The cross sectional configuration of the device is such that upon eversion thereof occasioned by an over-pressurization of the container contents, the material along the first circular line will fracture at at least one location, thereby allowing the container contents to escape therethrough.

6 Claims, 12 Drawing Figures

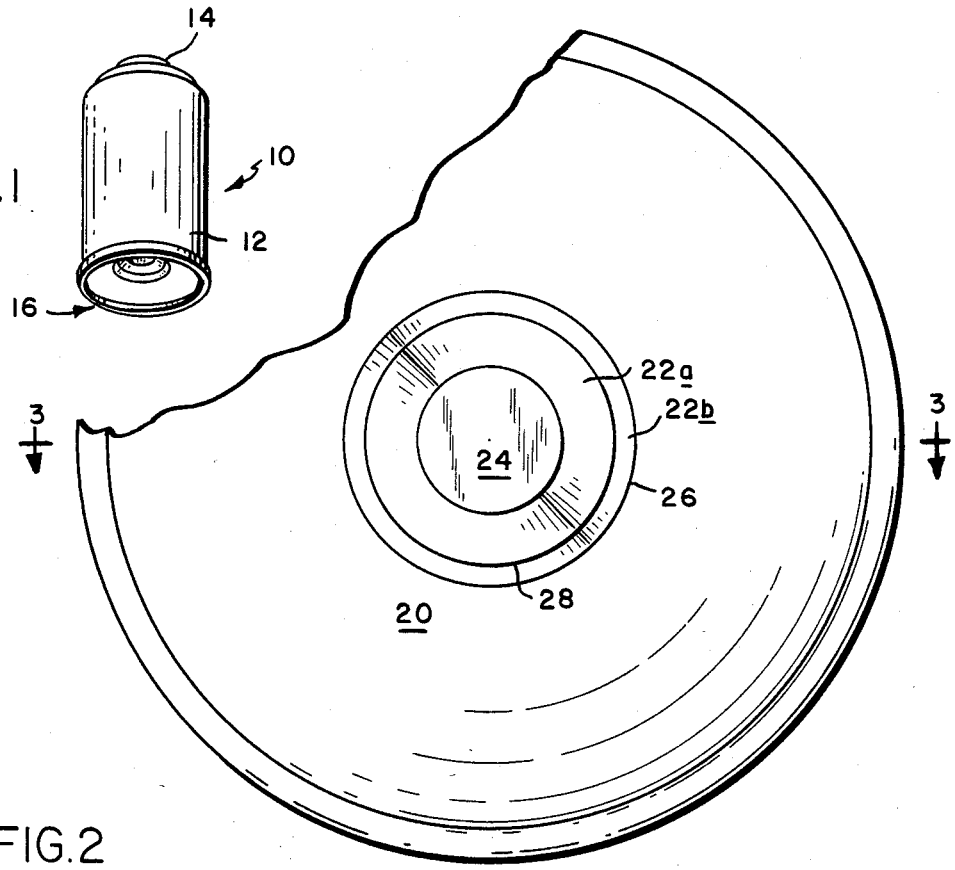
FIG. 1
FIG. 2
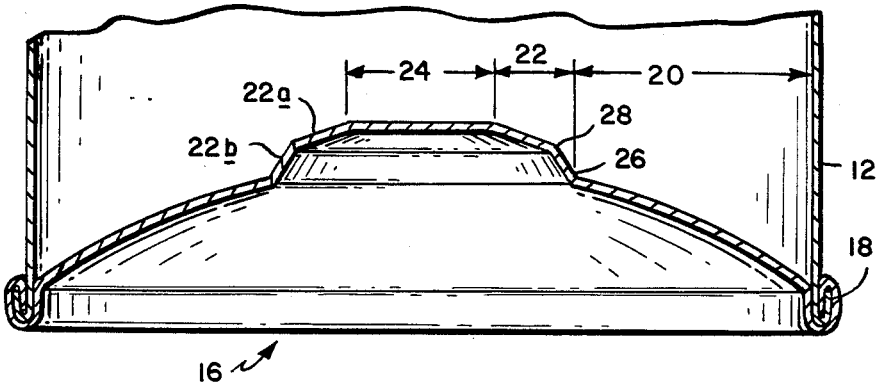
FIG. 3

COINLESS PRESSURE RELIEF DEVICE

BACKGROUND OF THE INVENTION

This invention relates to pressure release devices for internally pressurized fluid containers.

Pressurized fluid containers are in widespread use for packaging and dispensing a variety of fluid products, including liquids, gases, solids and combinations thereof. Under normal operating conditions, such containers perform entirely satisfactorily. However, in the event that the contents of such containers become overpressurized, either because of improper use, exposure to heat or for any other reason, then a violent rupture may occur. For the last 28 years, those skilled in the art have been attempting to solve this problem by incorporating various types of pressure release devices into the container structures. Examples of some of these previously developed pressure release devices are disclosed in U.S. Pat. Nos. 2,795,350 (Lapin); 3,292,826 (Abplanalp); 3,512,685 (Ewald); 3,622,051 (Benson); 3,724,727 (Zundel); 3,786,967 (Giocomo); 3,815,534 (Kneusel); 3,826,412 (Kneusel); 3,831,822 (Zundel); 4,003,505 (Hardt); 4,347,942 (Jernberg et al.); 4,416,388 (Mulawski); and 4,433,791 (Mulawski). In these prior art devices, scored or coined lines of reduced material thickness are caused to fracture in response to an overpressurization of the container contents, thereby creating vent openings.

Other types of pressure relief devices are disclosed in U.S. Pat. Nos. 2,951,614 (Greene); 3,356,257 (Eimer); 3,515,308 (Hayes); 3,759,414 (Beard) and 4,158,422 (Witten et al.).

Of the foregoing devices, it appears that only those disclosed in the Giocomo U.S. Pat. No. 3,786,967 and Mulawski U.S. Pat. No. 4,433,791, patents have achieved any significant measure of commercial acceptance. Such devices, however, are difficult and expensive to manufacture in the large quantities needed to fill existing commercial demands. The problem stems from the need to consistently maintain a prescribed coin depth along the line or lines surrounding either a pressure release tab or a rim of the container. This is particularly true of the device disclosed in the Mulawski U.S. Pat. No. 4,433,791, patent where for example, when manufacturing the device from sheet steel having a thickness of 0.015", the coined depth must be maintained within an extremely narrow range of between about 0.0015" and 0.0025" in order to insure that pressure is released within a range of between about 210 to 250 psig. A shallower coin depth will result in an unacceptably high pressure release, thereby presenting a risk that the container bottom will be blown off. On the other hand, a deeper coin depth may produce a prematurely low pressure release, in addition to encouraging the development of micro cracks in the remaining relatively thin membrane at the base of the coined line. These micro cracks may not always be detectable at the time of manufacture. They may occur later after the container has been filled with a pressurized product, thereby resulting in leakage and potentially costly losses.

Thus, the manufacturing process must be carefully monitored with particular attention to timely equipment adjustments to compensate for tool wear, and, when appropriate, to replace worn tools. This requires frequent product sampling and testing, all of which significantly increases manufacturing costs.

The objective of the present invention is to provide an improved and highly effective pressure release device which is entirely free of scored or coined lines, thereby obviating many of the above-described production problems associated with the prior art devices.

SUMMARY OF THE INVENTION

The pressure relief device of the present invention is imperforate, forms an integral part of the container surface and has a concave annular outer area integrally joined to an inwardly protruding circular central area by an annular intermediate area. These areas are devoid of any scored or coined lines, and have different thicknesses resulting exclusively from the closure element having been drawn from a metal blank. The juncture of the annular outer and annular intermediate areas forms a first circular line of strain hardened material having a reduced thickness and increased hardness and strength as compared with the material thickness, hardness and strength of the annular outer area. The cross sectional configuration of the device is such that upon eversion thereof occasioned by an overpressurization of the contents of the container, the first circular line will fracture at at least one and preferably at several discrete locations, thereby allowing the container contents to escape through such fracture or fractures in a controlled manner.

The annular intermediate area preferably includes a second circular line of strain hardened material having a reduced thickness and increased hardness and strength as compared to the thickness, hardness and strength of the first circular line.

Eversion of the device occurs initially at the annular outer area in the form of multiple reversals which spread circumferentially until they encounter one another along radial ridge lines. The fracturing of the first circular line eventually occurs where it is intersected by the radial ridge lines. The second circular line acts as a barrier which prevents the ridge lines from penetrating into the circular central area.

In the preferred embodiment to be described hereinafter, the second circular line is formed at a shoulder joining inner and outer mutually offset annular regions of the annular intermediate area.

BRIEF DESCRIPTION OF THE DRAWINGS

A preferred embodiment of the invention will now be described with reference to the accompanying drawings wherein:

FIG. 1 is a bottom perspective view of a container including a pressure release device in accordance with the present invention;

FIG. 2 is a partial bottom plan view on a greatly enlarged scale of the container shown in FIG. 1;

FIG. 3 is a sectional view taken along line 3—3 of FIG. 2;

DETAILED DESCRIPTION OF DISCLOSED EMBODIMENT

Referring initially to FIGS. 1-3, a container of the type conventionally employed to package and dispense pressurized fluid products is shown at 10. The container has a cylindrical side wall 12 with a reduced diameter neck 14 at one end to accommodate acceptance of a conventional cap, dispensing device or the like (not shown). The opposite end of the container is closed by a pressure relief device 16 in accordance with the present invention.

Figure 4:
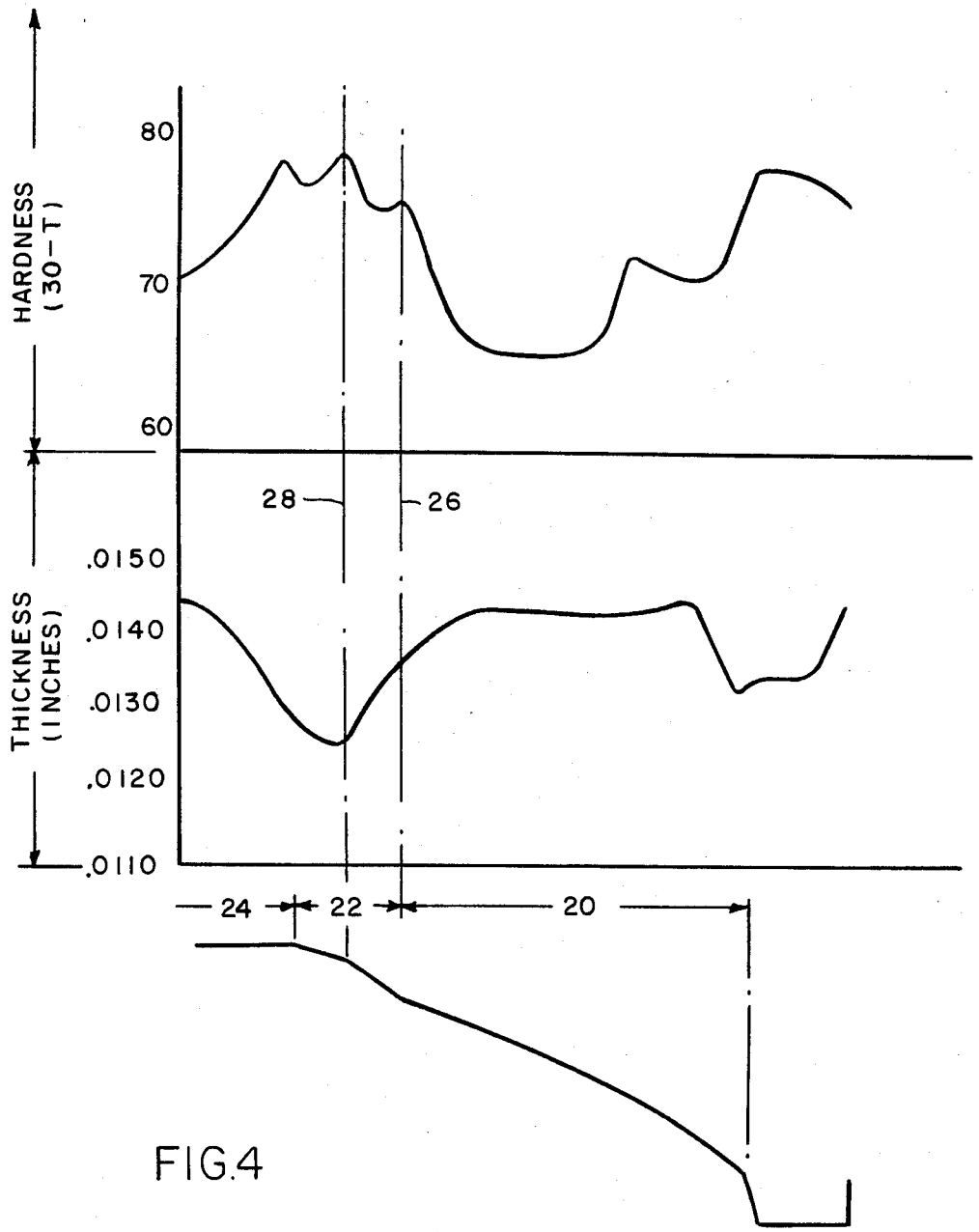
FIG. 4 is a graph showing the variations in material thickness and hardness along a cross section of a typical embodiment of the pressure relief device of the present invention.

The pressure relief device is imperforate and has its periphery adapted to be connected to the container side wall 12 by any conventional means, such as for example the double seam connection shown at 18. The device has a concave annular outer area 20 bordered by a shaped periphery forming the double seam connection 18. Annular outer area 20 is integrally joined by means of an annular intermediate area 22 to an inwardly protruding circular central area 24. The areas 20, 22 and 24 are entirely free of weakened lines produced by scoring or coining. As herein employed, the terms "scoring" and "coining" refer to closed-die squeezing operations, usually performed cold, in which all surfaces of the work are confined or restrained, resulting in a well-defined imprint of the die upon the work. The areas 20, 22 and 24 have varying thickneses resulting exclusively from the device having been drawn from a metal blank, with accompanying unequal strain hardening resulting in hardness variations. As herein employed, "strain hardening" is defined as an increase in hardness and strength caused by plastic deformation at temperatures lower than the recrystalization range. For a typical device drawn from a blank of T4 tin coated steel sheet stock having an as rolled thickness of 0.015", the resulting variations in thickness and hardness are graphically depicted in FIG. 4.

The annular outer area 20 joins the annular intermediate area 22 at a first circular line 26 of strain hardened material having a reduced thickness and increased hardness and strength as compared with the thickness, hardness and strength of the adjacent portion of the annular outer area 20. Thus, it will be seen that in the typical embodiment illustrated in FIG. 4, the material at circular line 26 has a thickness of 0.0135" which is less than the minimum thickness of the adjacent material in annular area 20, and a 30T Rockwell hardness of 75.5 which is greater than the maximum hardness of the adjacent material in annular area 20. The annular intermediate area 22 has a second circular line 28 of strain hardened material having a reduced thickness and increased hardness and strength as compared to the thickness, hardness and strength of the material at the first circular line 26. Thus, and again with reference to the typical embodiment shown in FIG. 4, the material at line 28 has a minimum thickness of 0.0125" and a maximum 30T Rockwell hardness of 79. The first circular line 26 lies on a shoulder at the juncture of the annular areas 20 and 22, and the second circular line 28 lies on a shoulder at the juncture of two mutually angularly offset annular regions **22*a* and 22*b*. The circular central area 24 is located inwardly with respect to annular areas 20 and 22** and is essentially flat.

Figure 5A:
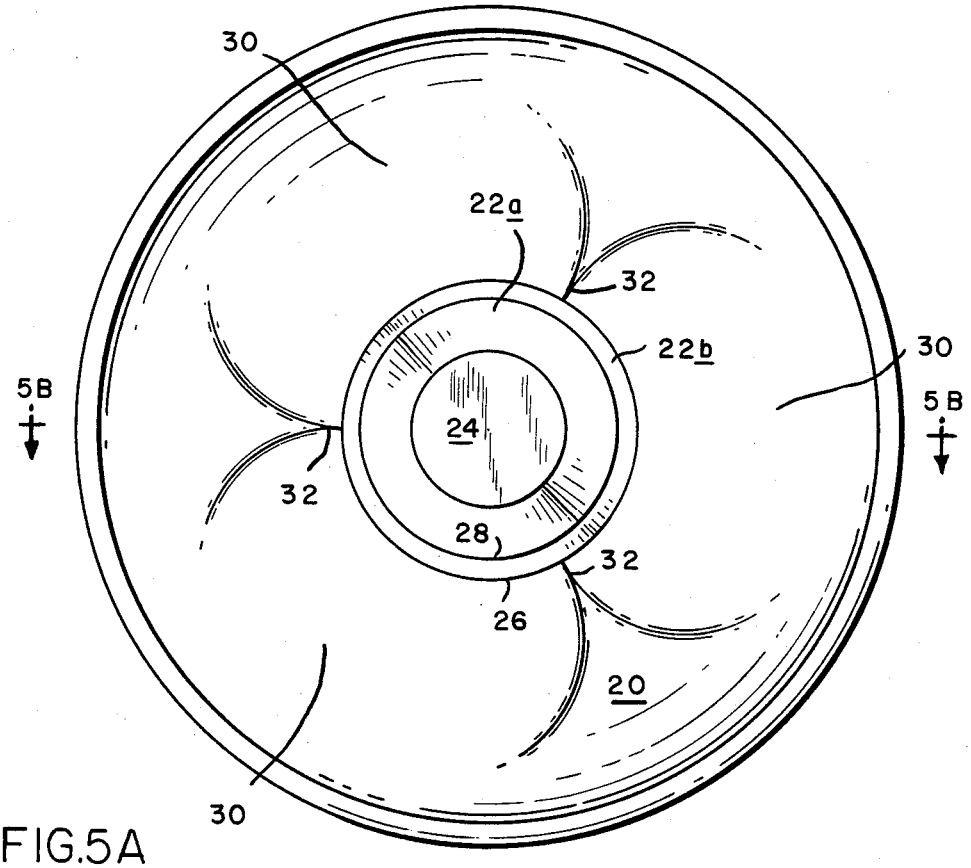
FIGS. 5A, 6A, and 7A are bottom plan views showing how the pressure relief device of the present invention reacts to an overpressurization of the container contents.
Figure 5B:
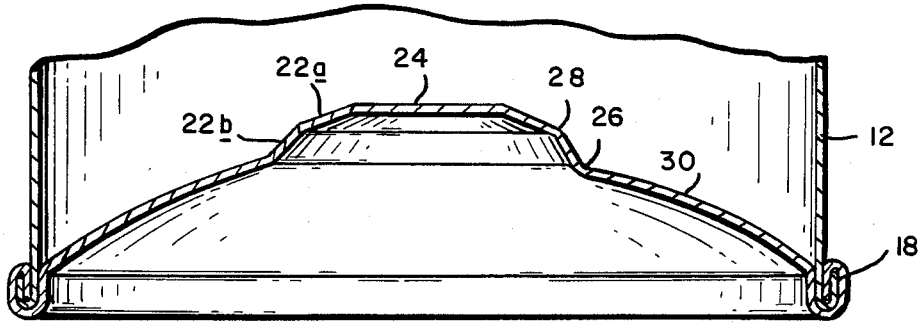
FIGS. 5B, 6B and 7B are sectional views taken respectively along lines 5B—5B, 6B—6B and 7B—7B of FIGS. 5A, 6A and 7A.

The manner in which the pressure relief device reacts to an overpressurization of the container contents is illustrated in progressive stages in FIGS. 5A, 5B; 6A, 6B, 6C; and 7A, 7B. Referring initially to FIGS. 5A and 5B, it will be seen that the initial reaction to overpressurization consists of multiple mini-eversions or reversals 30 in the annular outer area 20. The reversals 30 rapidly expand circumferentially until they encounter one another along radial ridge lines 32.

Figure 6A:
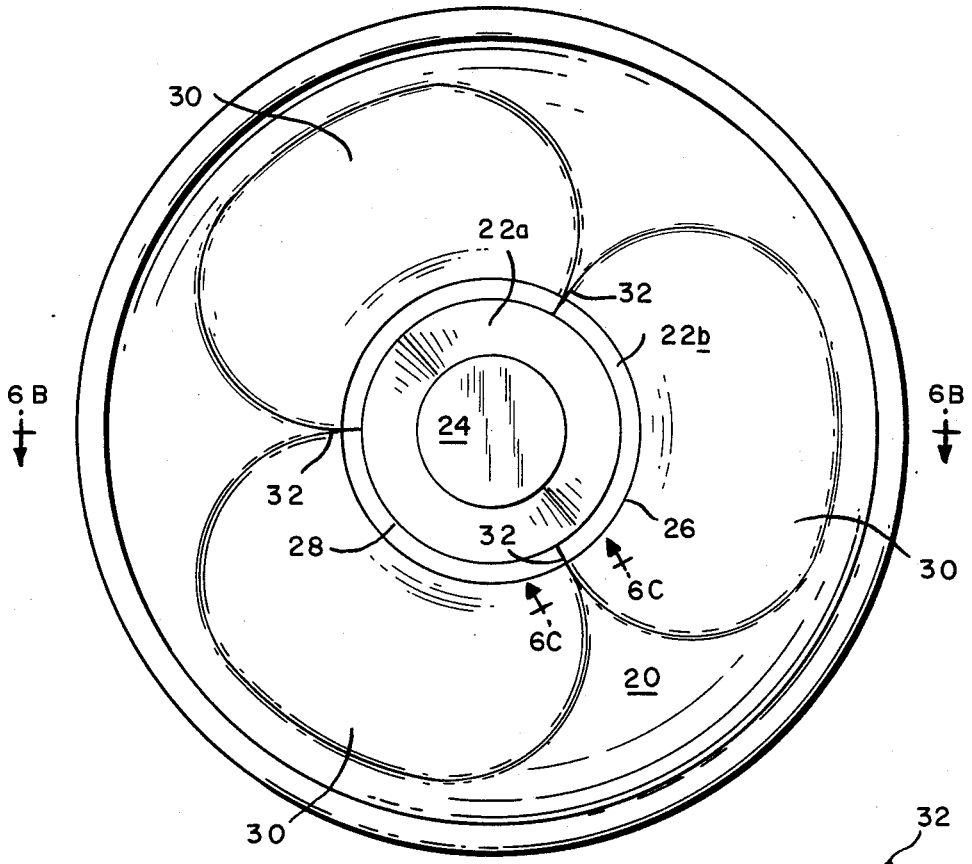
Figure 6C:
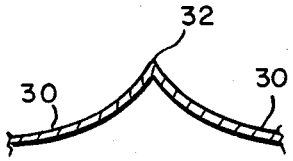
FIG. 6C is a sectional view taken along line 6C—6C of FIG. 6A.
Figure 6B:
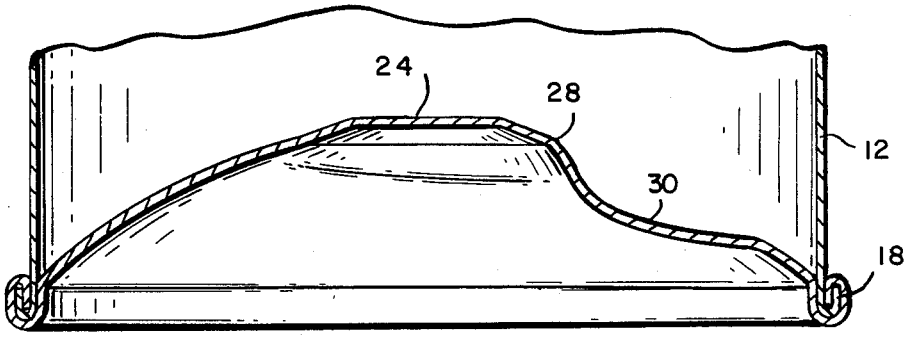

As shown in FIGS. 6A 6B and 6C, as the container pressure continues to increase, the size and depth of the reversals 30 also increase, causing the radial ridge lines 32 to become more pronounced and to eventually penetrate radially inwardly across the first circular line 26 into the region **22*b* of annular area 22. Preferably, the reversals 30 are initially isolated from the double seam connection 18 by providing the outlying portion of annular area 20 with a slightly reduced radius of curvature. Continued radial penetration of the ridge lines 32 is eventually arrested or at least substantially impeded by the hardness and strength of the second circular line 28, thereby allowing the circular central area 24** to remain essentially undisturbed.

At this stage, as a result of the radial ridge lines 32 having progressed across the first circular line 26, the material at the multiple intersections of lines 32 and 26 has been strain hardened a second time to a still higher hardness level.

Figure 7A:
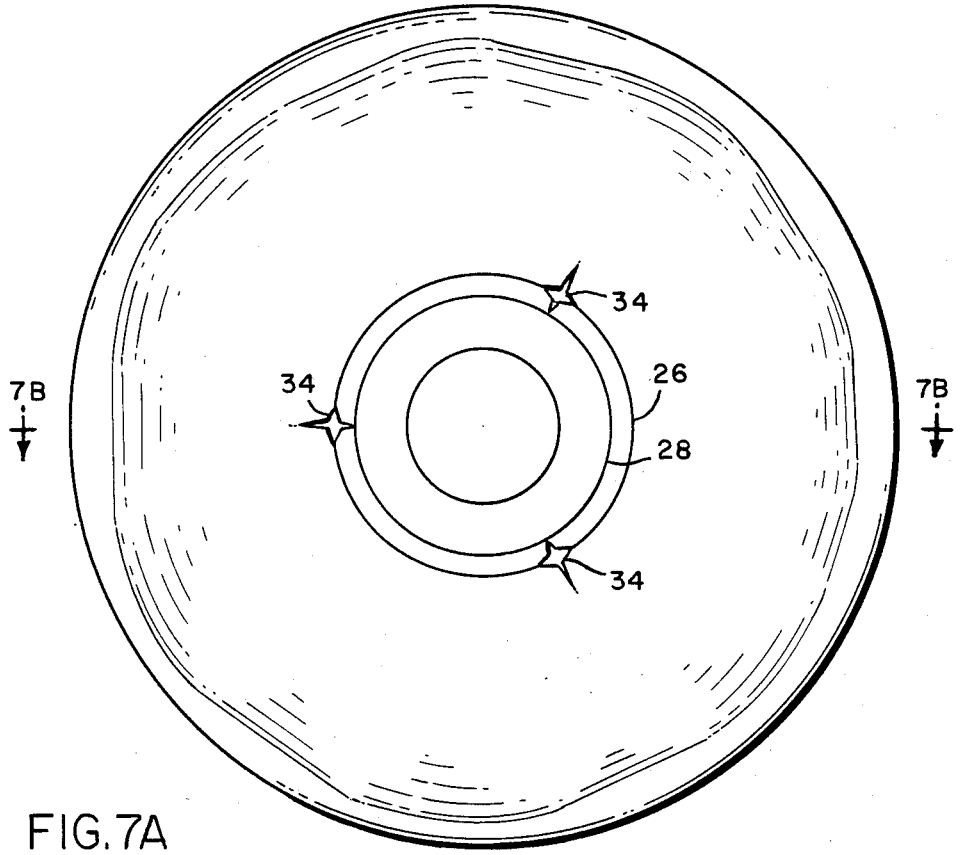
Figure 7B:
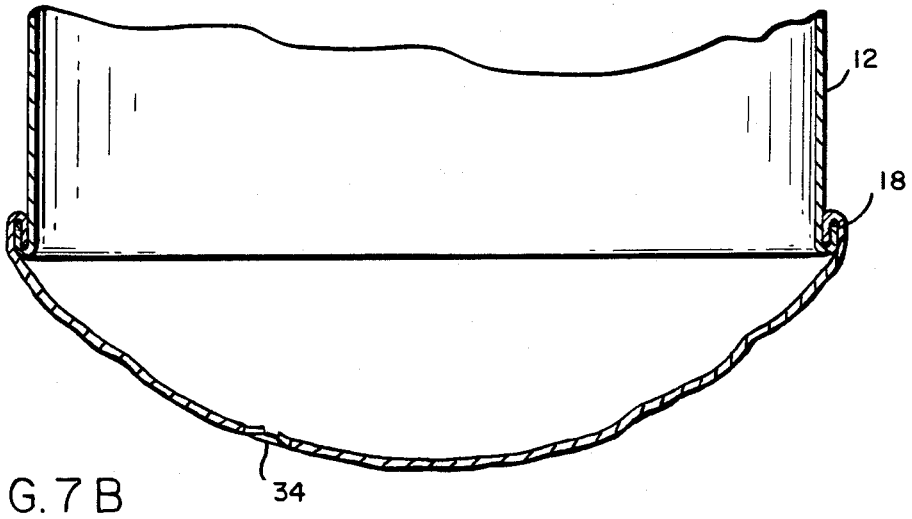

With reference to FIGS. 7A and 7B, it will be seen that as the container pressure continues to increase, the circular central area 24 and the annular intermediate area 22 are eventually caused to evert along with the remainder of the annular outer area 20. This produces a reverse buckling of the ridge lines 32 with an accompanying third strain hardening of the material at the locations where they intersect with the first circular line 26. This third strain hardening finally exceeds the yield strength of the material, producing discrete fractures 34 along line 26. The fractures occur along transverse axes, one axis being radial in the direction of the ridge lines 32, and the other axis lying on line 26. The fractures are sufficient in area to vent the pressurized container contents in a controlled manner, and at a pressure well below that which would endanger the integrity of the double seam connection 18.

In light of the foregoing, it will now be appreciated by those skilled in the art that the two strain hardened lines 26, 28 coact with the remainder of the pressure relief device in response to internal overpressurization to produce discrete venting fractures without relying on scored or coined lines. The material at line 26 is strain hardened a first time during the initial drawing of the device. That material is strain hardened a second time by the penetration thereacross of the radial ridge lines 32. That penetration is eventually blocked by the high strength second strain hardened line 28. Subsequent full eversion produces a reverse buckling of the ridge lines, with an accompanying third strain hardening at the intersections of the ridge lines 32 with the first circular line 26. It is at this point that the material yield strength is finally exceeded, resulting in the creation of the discrete fractures 34.

Figure 8:
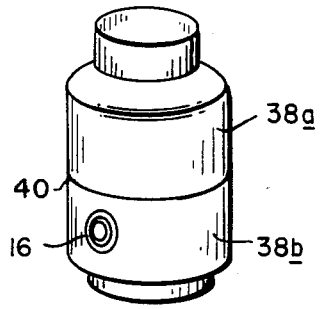
FIG. 8 is a perspective view of another style of container having a pressure relief device in accordance with the present invention forming an integral part of the container side wall.

The pressure relief device of the present invention is not limited to use as part of a container bottom. For example, as shown in FIG. 8, the device 16 may be integrally drawn as part of the side wall of a container of the type having two halves 38*a*, 38*b* joined as by welding at 40.

Alternatively, the device may be incorporated into a one piece container, and the device may be drawn from metals other than steel, for example aluminum.

It is my intention to cover these and any other modifications which are within the scope of the claims appended hereto.

I claim:

1. A pressure relief device for venting an internally pressurized container, said device being imperforate, forming an integral part of the container surface, and having a concave annular outer area integrally joined to an axially inwardly protruding circular central area by an annular intermediate area, said areas having different thicknesses resulting exclusively from said device having been drawn from a metal blank, with the juncture of said annular outer area and said annular intermediate area forming a first circular line of strain hardened material having a reduced thickness and increased hardness and strength as compared to the material thickness, hardnes and strength of the adjacent portion of said annular outer area, and wherein said annular intermediate area has a second circular line of strain hardened material which is concentric with said first circular line and which has a reduced thickness and increased hardness and strength as compared to the thickness, hardness and strength of said first circular line, the cross sectional configuration of said device being such that upon eversion thereof occasioned by an overpressurization of the contents of said container, the material along said first circular line will fracture at at least one location, thereby allowing the container contents to escape through said fracture.

2. The pressure relief device of claim 1 wherein said eversion occurs initially in said annular outer area as multiple reversals which encounter one another along radial ridge lines, and wherein the said fracturing occurs at the intersection of said ridge lines with said first circular line.

3. The pressure relief device of claim 2 wherein the hardness and strength of said second circular line is sufficient to prevent said radial ridge line from penetrating into said circular central area.

4. The pressure relief device of claim 1 wherein said second circular line is formed at a shoulder joining inner and outer mutually offset annular regions of said annular intermediate area.

5. A pressure relief device for venting an internally pressurized container of the type having a cylindrical side wall, said device being drawn from a metal blank and being adapted to be circumferentially joined to one end of said side wall, said device being imperforate and free of coined lines or the like and having an axially inwardly protruding central area surrounded by strain hardened concentric radially spaced inner and outer circular lines of reduced material thickness, the cross-sectional configuration of said device being such that upon eversion thereof occasioned by an overpressurization of the container contents, said device will undergo fracturing at multiple discrete sites which are located radially outwardly of said inner circular line and which are spaced along said outer circular line, thereby allowing the container contents to escape through said fractures.

6. A pressure relief device for venting an internally pressurized container of the type having a cylindrical side wall, said device being drawn from a metal blank and being adapted to be circumferentially joined to one end of said side wall, said device having a concave annular outer area integrally connected to a circular central area by a concave annular intermediate area, the juncture of said annular intermediate area and said annular outer area forming a circular first shoulder with at least one circular second shoulder being formed between said first shoulder and said central area, the metal at said annular outer area, said first shoulder and said second shoulder having been drawn respectively to progressively reduced thicknesses with accompanying progressively increased strain hardening, the cross sectional configuration of said device being such that upon eversion thereof occasioned by an overpressurization of the container contents, said device will fracture at multiple discrete sites which are located radially outwardly of said second shoulder and which are spaced along said first circular shoulder, thereby allowing the container contents to escape through said fractures.

* * * * *